US012478133B2

(12) United States Patent
Swager Van Dok et al.

(10) Patent No.: US 12,478,133 B2
(45) Date of Patent: Nov. 25, 2025

(54) SHOE SOLE

(71) Applicant: X10D AG, Langenthal (CH)

(72) Inventors: Jan Swager Van Dok, Grenchen (CH); Tobias Schumacher, Langenthal (CH)

(73) Assignee: X10D AG, Langenthal (CH)

( * ) Notice: Subject to any disclaimer, the term of this patent is extended or adjusted under 35 U.S.C. 154(b) by 0 days.

(21) Appl. No.: 18/833,111

(22) PCT Filed: Feb. 6, 2023

(86) PCT No.: PCT/EP2023/052880
§ 371 (c)(1),
(2) Date: Jul. 25, 2024

(87) PCT Pub. No.: WO2023/152094
PCT Pub. Date: Aug. 17, 2023

(65) Prior Publication Data

US 2025/0107594 A1 Apr. 3, 2025

(30) Foreign Application Priority Data

Feb. 8, 2022 (CH) ..... 000110/2022
Feb. 15, 2022 (CH) ..... 000145/2022

(51) Int. Cl.
*A43B 13/14* (2006.01)

(52) U.S. Cl.
CPC ..... *A43B 13/14* (2013.01)

(58) Field of Classification Search
None
See application file for complete search history.

(56) References Cited

U.S. PATENT DOCUMENTS 1,232,518 A * 7/1917 Emery ..... A43C 15/161 152/210
1,907,136 A * 5/1933 Weitsen ..... A43B 7/14 36/43

(Continued)

FOREIGN PATENT DOCUMENTS

WO 2013/056864 A1 4/2013
WO 2014/071977 A1 5/2014

(Continued)

OTHER PUBLICATIONS

Jun. 15, 2023 International Search Report issued in International Patent Application No. PCT/EP2023/052880.

(Continued)

*Primary Examiner* — Jila M Mohandesi
(74) *Attorney, Agent, or Firm* — Oliff PLC

(57) ABSTRACT

A shoe sole with a guide element which is embedded between a ground contact surface and a foot contact surface of the shoe sole, is designed to control the optimum movement sequence of the foot, has a smaller width extension than the shoe sole and extends along an S-shaped line, in such a way that the shoe sole further supports the natural or correct gait of the user, it is proposed that the guide element is a proprioceptive guide element and has elevations extending towards the foot contact surface, and/or that the shoe sole has, in the heel section arranged medially to the substantially S-shaped line, a stabilization element which can be detachably fastened in the shoe sole and which extends out of the shoe sole in the direction of and up to the plane of the ground contact surface.

2 Claims, 8 Drawing Sheets

(56) References Cited

U.S. PATENT DOCUMENTS 2,101,761 A * 12/1937 Stagl ..... A43B 7/14 36/145
2,185,526 A * 1/1940 Silver ..... A43B 7/22 36/163
4,316,335 A * 2/1982 Giese ..... A43B 7/1445 36/129
4,380,878 A * 4/1983 Skaja ..... A43B 5/06 36/129
4,897,936 A * 2/1990 Fuerst ..... A43B 13/223 36/31
5,014,706 A * 5/1991 Philipp ..... A43B 7/145 36/43
5,086,574 A * 2/1992 Bacchiocchi ..... A43B 21/26 36/36 A
5,282,326 A * 2/1994 Schroer, Jr. ..... A43B 17/023 36/145
5,625,965 A * 5/1997 Blissett ..... A43B 13/38 36/43
5,657,556 A * 8/1997 Bemis ..... A43C 15/161 12/142 P
5,815,949 A * 10/1998 Sessa ..... A43B 1/0072 36/28
7,254,907 B2 * 8/2007 Nishiwaki ..... A43B 7/1425 36/31
7,421,805 B2 * 9/2008 Geer ..... A43B 3/0057 36/31
7,451,557 B2 * 11/2008 McDonald ..... A43B 3/246 36/105
7,832,119 B2 * 11/2010 Gilmore ..... A61F 5/14 36/180
D874,115 S * 2/2020 Cheskin ..... D2/961
2003/0192202 A1 * 10/2003 Schoenborn ..... A43B 13/16 36/31
2015/0157089 A1 * 6/2015 Schumacher ..... A43B 3/0057 36/25 R
2015/0282558 A1 10/2015 Rawls-Meehan et al.

FOREIGN PATENT DOCUMENTS

WO 2016/092353 A1 6/2016
WO 2018/044954 A1 3/2018
WO 2020/058519 A1 3/2020

OTHER PUBLICATIONS

May 15, 2024 International Preliminary Report on Patentability issued in International Patent Application No. PCT/EP2023/052880.

* cited by examiner

SHOE SOLE

TECHNICAL AREA

The invention relates to a shoe sole suitable for an article of footwear according to the general concept of embodiment 1.

STATE OF THE ART

A shoe sole according to the general term of embodiment 1 is known from the publication WO 2013056864 A1. This known shoe sole has an insole which is designed to support a physiological gait pattern, i.e. a natural or correct gait.

In a natural or correct gait, the feet touch the ground alternately, whereby when the foot touches the ground, it first touches the ground with its heel or touches the ground with its heel and midfoot at the same time. The foot then begins to roll on the ground with a slight deformation of the foot, whereby its heel section, midfoot section, ball of the foot section and forefoot section come into contact with the ground. In doing so, the foot defines a ground contact line, or more precisely a gait line, such as a physiological gait line.

Optimally, i.e. in a person with healthy bones, tendons, muscles and nerves and a natural gait, this gait line is typically an essentially/approximately S-shaped line on the sole of each foot. An optimal gait line begins at the heel section, runs along the midfoot and ball of the foot sections and ends at the forefoot section, typically on the medial side of the forefoot section in the area of the first and second midfoot sections and the first and second toes.

In order to support the proprioception of the foot, i.e. the perception of the position of the foot in space, in particular the perception of the gait line, WO 2013056864 A1 provides a shoe sole which has a narrower insole compared to the shoe sole, whereby the insole extends along an S-shaped line of the shoe sole. In order to proprioception and control the optimal movement of the foot, this known insole is made of a harder material than the shoe sole material surrounding the insole. Following the rules of Newton's third law, the harder insole generates a counter-pressure against the pressure exerted by the foot on the sole when walking.

Furthermore, a modular insole system for shoe soles is known from publication WO 2016092353 A1. This modular insole system comprises a relatively soft, resilient midsole and hard insert elements which are intended for insertion into vertical cavities in the midsole. The natural or correct gait of the user can be supported by varying the hardness of the inserts in the different vertical cavities. In particular, pronation, i.e. an inward rotation of the foot in which the lateral foot area is raised and the medial foot area is lowered, is adapted to the wearer's gait.

DESCRIPTION OF THE INVENTION: TASK, SOLUTION, ADVANTAGES

The invention is based on the task of further developing a shoe sole of the type mentioned at the beginning in such a way that the shoe sole further supports the natural or correct gait of the user. The shoe sole is intended to optimize the perception of the optimum gait line. In particular, the shoe sole should guide the user's foot to the optimum gait line.

This task is solved by a shoe sole with the features specified in embodiment 1 and by a shoe sole with the features specified in embodiment 14. Advantageous embodiments and useful further embodiments of the present invention are characterized in the respective dependent claims. Accordingly, the present invention is based on forming the guide element or at least one of the guide elements as a proprioceptive guide element with elevations extending towards the foot contact surface, wherein the elevations are arranged at least in regions along the S-shaped line and are designed to impart localized pressure elevations to the foot of the wearer of the shoe sole. The proprioceptive guide element is thus designed to give the wearer's foot a localized increase in pressure at least in certain areas along the S-shaped line.

The S-shaped line is an imaginary line that runs through the middle of the physiological gait line. In the present case, the physiological gait line refers to the line of ground contact of the foot during a natural or correct gait. This begins at the heel section and runs in an S-shape from an area of the heel section located medial to the middle of the foot, along the midfoot and ball of the foot sections and ends at the forefoot section. In the midfoot section, the S-shaped line typically runs through an area of the midfoot section located laterally to the center of the foot and then first runs centrally through the ball of the foot section and then through an area of the ball of the foot section located medially to the center of the foot. On the forefoot section, the S-shaped line typically ends on a side of the forefoot section arranged medially to the center of the foot in the area of the first and second metatarsal sections and the first and second toes.

In order to give the wearer's foot a localized increase in pressure at least in certain areas along the S-shaped line, the elevations are arranged at least in certain areas along the S-shaped line, for example in the area of the heel section of the S-shaped line and in the area of the ball of the foot section of the S-shaped line and in the area of the forefoot section of the S-shaped line. The localized pressure elevations promote the user's proprioception of the foot when walking, in particular the perception of the optimal gait line. The elevations activate and stimulate the foot. The proprioceptive guidance element guides the foot to the physiological gait line because the foot follows the localized pressure elevations.

Independently thereof or in connection therewith, the present invention is based on the fact that the shoe sole has, in the heel section arranged medially to the substantially S-shaped line, a stabilizing element which is detachably fastened in the shoe sole and which extends out of the shoe sole in the direction of and up to the plane of the ground contact surface. In the present case, the heel section is also referred to as the transition area between the heel section and the midfoot section. The stabilization element is used to regulate the proprioception of the foot when walking, for example to regulate the intensity of the perception of the gait line. Since intensive proprioception of the foot during walking can be strenuous or tiring for the user over long periods of time, it is helpful if the stabilization element can be used to relieve the foot when necessary. The stabilization element can therefore be used to optimize the intensity of proprioception, in particular the intensity of perception of the optimal gait line, as required.

If the stabilization element is attached to the sole of the shoe, it supports the medial inner area of the heel section. This stabilizes the hindfoot or heel bone, regulates the pronation of the foot and slightly reduces the intensity of the foot's proprioception when walking. The stabilization element thus guides the foot to the physiological gait line and controls the optimal movement sequence of the foot. With the stabilization element in place, the wearer of the shoe sole needs to walk less actively, i.e. needs to activate the foot muscles less, as the stabilization element supports the heel bone medially.

To promote proprioception, in an advantageous embodiment of the present invention, the ground contact surface has a smaller width extension than the shoe sole. Preferably, therefore, both the proprioceptive guiding element and the ground contact surface extend along the S-shaped line. In other words, in this advantageous embodiment example, the ground contact surface in the midfoot section comprises a recess medially and laterally.

Advantageously, the shoe sole therefore has at least one midsole, for example a sole body or body, whereby the proprioceptive guide element and the ground contact surface are narrower than the midsole. The width of the proprioceptive guide element and the ground contact surface is therefore preferably smaller than the width of the midsole or the sole body.

In particular, the heel section of the ground contact surface and the proprioceptive guide element has a smaller area, for example by at least 1/20, for example by at least 1/10, preferably by at least 1/8, than the heel section of the midsole.

The heel section of the ground contact surface and the proprioceptive guide element therefore has a recess compared to the heel area of the midsole. This recess surrounds the heel section and is also formed in the medially inner area of the heel section. In the area of the recess, which is arranged in the medially inner area of the heel section, the shoe sole preferably has a receiving element designed to receive the stabilization element. For example, the ground contact area of the heel section can fill approximately 3/4 of the ground contact area of the heel section and the receiving element designed to receive the stabilization element can fill approximately 1/4 of the ground contact area of the heel section.

Furthermore, the midfoot section of the ground contact surface and the proprioceptive guide element has a smaller area, for example by at least 1/4, approximately by at least 1/3, preferably by at least half, than the midfoot section of the midsole.

The ball of the foot section of the ground contact surface and the proprioceptive guide element advantageously has a smaller area, for example by at least 1/20, for example by at least 1/15, preferably by at least 1/10, than the ball of the foot section of the midsole.

The forefoot section of the ground contact surface and the proprioceptive guide element has a smaller area, for example by at least 1/3, approximately by at least half, preferably by at least 3/5, than the forefoot section of the midsole. Thus, the forefoot section of the ground contact surface and the proprioceptive guide element can have approximately the width of a big toe and the forefoot section can have the width of the entire forefoot.

The narrower design of the proprioceptive guide element and the ground contact surface compared to the midsole result in lateral instability, in other words a tendency for the foot to roll or tilt around the longitudinal axis when walking or running. This transverse instability promotes the natural or correct gait and proprioception of the user's foot.

In an embodiment in which both the proprioceptive guide element and the ground contact surface extend along the S-shaped line, the stabilization element is particularly helpful for relieving the foot during fatigue. The stabilization element according to the invention stabilizes the sole of the shoe when walking in the area of the heel section or hindfoot, but does not completely reduce the transverse instability. This means that the transverse instability remains in a somewhat weakened form. In contrast, a shoe sole in which the ground contact surface extends over the entire width of the shoe, such as the shoe sole known from publication WO 2016092353 A1, has no transverse instability.

According to the invention, the stabilization element is arranged in the heel section or heel area. This has the advantage that the shape and size of the ground contact surface of the shoe sole remain unchanged, irrespective of whether the stabilizing element is inserted into the shoe sole or not.

To further reinforce proprioception, the proprioceptive guide element can be made of a harder material, in particular of at least one harder elastomer, than the shoe sole material surrounding the proprioceptive guide element. For example, the proprioceptive guide element can be made from at least one material selected from the group of thermoplastic polyurethanes (TPU) and the shoe sole material surrounding the proprioceptive guide element, in particular the material of the midsole, can be made from at least one softer elastomer, for example from a material selected from the group of polyurethanes (PU) and/or ethylene vinyl acetates (EVA).

In a preferred embodiment of the present invention, the

- the hardness of the proprioceptive guide element in the range from about 75 Shore to about 90 Shore, for example from about 81 Shore to about 90 Shore, and
- the hardness of the midsole in the range from about 40 Shore to about 70 Shore and/or
- the hardness of the ground contact surface in the range from about 40 Shore to about 70 Shore.

The hardness of the stabilization element is advantageously in a range from around 20 Shore to around 95 Shore, preferably between 50 Shore and 90 Shore.

The harder the stabilization element is, the more medially stable the shoe sole is.

The proprioceptive guide element and/or the midsole and/or the ground contact surface can have a uniform hardness or different hardnesses within the aforementioned ranges. Furthermore, the proprioceptive guide element and/or the midsole and/or the ground contact surface can have a uniform thickness or vary in thickness.

In other words, as described in WO 2013056864 A1, the shoe sole may comprise first sole portions extending along the S-shaped line and second sole portions extending along both sides of the substantially S-shaped line.

In the present case, the sole of the shoe can therefore comprise the proprioceptive guide element and the outsole as the first sole sections, as well as optionally the stabilizing guide element and areas of other sole elements arranged in a vertical plane with the proprioceptive guide element, such as areas of the midsole extending along the S-shaped line.

As second sole sections, the shoe sole can comprise the outsole and optionally areas of other sole elements laterally adjacent to the proprioceptive guidance element, such as the midsole.

The local thickness and/or the local hardness of a first sole section, for example the proprioceptive guide element and/or the stabilizing guide element, can be greater than the local thickness and/or the local hardness of a second sole section, for example the midsole, adjacent to the first sole section. In the present case, the local thickness and/or the local hardness of the proprioceptive guiding element and/or the stabilizing guiding element, for example in the area of the S-shaped line, can therefore be greater than the local thickness and/or the local hardness of the midsole.

For example, as described in publication WO 2013056864 A1, the local thickness of a first sole section may be greater than the local thickness of a second sole section adjacent to the first sole section, wherein the first sole section and the second sole section have the same hardness. Thus, the local thickness of the proprioceptive guiding element and/or the stabilizing guiding element may be greater than the local thickness of the midsole, wherein the proprioceptive guiding element and/or the stabilizing guiding element has the same local hardness as the midsole.

Furthermore, the local hardness of the proprioceptive guide element and/or the stabilizing guide element can be greater than the local hardness of the midsole, with the proprioceptive guide element and/or the stabilizing guide element having the same local thickness as the midsole.

The difference in local thickness and/or local hardness between

- the proprioceptive guiding element and the midsole and/or
- the stabilizing guiding element and the midsole, be greatest in the midfoot section extending between the heel section and the ball of the foot section. Such a distribution of local thickness and/or hardness provides the wearer's foot with a further localized increase in pressure along the S-shaped line, thus enhancing the proprioceptive effect.

Furthermore, in an advantageous embodiment of the present invention, the height and/or thickness of the outsole can be

- be thicker or higher in the medial area of the heel section, for example by about 1 mm to 1.5 mm, than in the lateral area of the heel section, and/or
- be lower in the medial area of the ball of the foot section, for example by about 1 mm to 2 mm, than in the lateral area of the ball of the foot section and/or
- be lower in the medial area of the forefoot section, for example by around 1 mm to 2 mm, than in the lateral area of the forefoot section.

In this way, the foot is optimally guided towards the physiological gait line.

Alternatively, or in conjunction with this, the shoe sole may comprise, in addition to the proprioceptive guide element, a further guide element extending along an S-shaped line, for example at least one stabilizing guide element. The stabilizing guide element is arranged between the ground contact surface and the proprioceptive guide element, in particular between the ground contact surface and the midsole. In order to control the optimal movement of the foot, the further guide element is made of a harder material than the shoe sole material, which laterally surrounds the further guide element, or which therefore extends along both sides of the essentially S-shaped line (G). For example, the proprioceptive guide element with the elevations can be made of at least one material selected from the group of polyurethanes (PU) and/or ethylene vinyl acetates (EVA) and/or thermoplastic polyurethanes (TPU) and the stabilizing guide element can be made of at least one material selected from the group of thermoplastic polyurethanes (TPU).

The stabilizing guide element stabilizes the sole of the shoe so that it always returns to its original shape despite deformation when walking. In addition, the stabilizing guide element supports the proprioceptive guide element and, according to the principle of interaction, provides a counterpressure to the pressure applied to the stabilizing guide element by the elevations of the proprioceptive guide element. The stabilizing guide element thus interacts with the proprioceptive guide element in such a way that the localized increases in pressure caused by the elevations are amplified. The proprioceptive guide element and the stabilizing guide element thus synergistically support the pressure line of the foot on contact with the ground as information on the physiological gait pattern. In an advantageous embodiment example, the hardness of the stabilizing guide element is at least 80 Shore, preferably over 80 Shore, for example in the range from about 81 Shore to about 98 Shore. The stabilizing guide element can have a uniform hardness or different hardnesses within the aforementioned ranges. Furthermore, the stabilizing guide element can have a uniform thickness or vary in thickness.

In an advantageous embodiment, the proprioceptive guiding element is harder than the midsole, but softer and therefore more dynamic, or in other words more flexible, than the stabilizing guiding element. In this case, the proprioceptive guide element transmits the hardness information of the stabilizing guide element to the foot. The interaction between the outsole, stabilizing guide element, midsole and proprioceptive guide element controls the intensity of the perception of the optimal gait line.

In an advantageous embodiment of the present invention, in addition to the proprioceptive guiding element, the stabilizing guiding element may also have elevations extending towards the foot contact surface, which are designed to impart a localized increase in pressure to the foot of the wearer of the shoe sole. These elevations are advantageously arranged analogously to the elevations of the proprioceptive guide element. As a result, the sole of the shoe provides increased pressure. The perception of proprioception and guidance to the physiological gait line is thus enhanced.

The elevations formed for localized pressure increase are preferably located in the area of the heel section, the ball of the foot section and the forefoot section. Advantageously, the elevations are therefore arranged along the S-shaped line, with the midfoot section being free of the elevations. Feedback of ground contact during walking in the area of the heel section, the ball of the foot section and the forefoot section is particularly helpful in supporting the user's natural or correct gait.

The elevations can be designed as ball segments, for example. Ball segments are particularly comfortable to wear and optimally activate the blood circulation in the foot.

By varying the size, in particular the height and/or volume, of the elevations, the foot can be guided to the optimum gait line. The pressure points of elevations of different heights can thus partially guide the foot to where it should roll. For example, the height of the pressure points can vary in a range from about 0.2 mm to about 4 mm, preferably in a range from about 1 mm to about 2 mm. For example, small elevations with a height of about 1 mm, medium elevations with a height of about 1.5 mm and large elevations with a height of about 2 mm can be provided.

In order to guide the user's foot to the optimum gait line, in an advantageous embodiment of the present invention the elevations in a heel region arranged medially from the substantially S-shaped line, i.e. in the heel region of the inner side of the foot, have a lower height and/or a lower volume than the elevations in a heel region arranged laterally from the substantially S-shaped line. The term "medially arranged from the essentially S-shaped line" refers to an area that is arranged towards the inside of the foot as seen from the S-shaped line. The term "laterally arranged from the essentially S-shaped line" refers to an area that is arranged towards the outside of the foot as seen from the S-shaped line.

Independently thereof or in connection therewith, in order to guide the user's foot to the optimal gait line, the elevations in a ball of the foot section located medially from the substantially S-shaped line may have a greater height and/or volume than the elevations in a ball of the foot section located laterally from the substantially S-shaped line.

To give the shoe sole an even better rolling action, recesses, in particular U-shaped or V-shaped notches, can be arranged in the outsole or in the outsole and the midsole. These recesses therefore extend from a side of the outsole arranged medially to the center of the foot to a side of the outsole arranged laterally to the center of the foot, for example transverse to the sole of the shoe or perpendicular to the S-shaped line. The width of the recesses corresponds to the width of the proprioceptive guide element. Along the longitudinal direction of the S-shaped line (G), the recesses are arranged at least on the heel section, the midfoot section and the ball of the foot section. The recesses are spaced apart from each other in the longitudinal direction. The longitudinal spacing of the recesses can be arranged regularly or irregularly, i.e. the spacing can vary. The recesses can extend as straight lines from one side of the sole of the shoe to the other. Alternatively, the recesses can also extend as curved or folded lines, for example in a C-shape, between the two sides of the outsole. The recesses are preferably located exclusively on the S-shaped line. The recesses cause the sole of the shoe to roll dynamically instead of continuously. The sole of the shoe rolls more easily, making it more flexible. This means that the wearer has to stabilize more.

The present invention further relates to a shoe sole of the type described above for gait correction or gait maintenance, in particular for the therapeutic treatment of foot malpositions during walking.

Finally, the present invention relates to a shoe comprising a shoe sole of the type described above.

BRIEF DESCRIPTION OF THE DRAWINGS

As already discussed above, there are various ways of advantageously designing and further developing the teaching of the present invention. For this purpose, reference is made on the one hand to the embodiments following embodiment 1, and on the other hand further embodiments, features and advantages of the present invention are explained in more detail below, inter alia with reference to the two embodiments illustrated by FIGS. 1 to 8.

It shows.

Identical or similar designs, elements or features are provided with identical reference symbols in FIGS. 1 to 8.

BEST WAY TO IMPLEMENT THE INVENTION

In the two embodiments of the present invention illustrated with reference to FIGS. 1 to 8, a shoe sole suitable for footwear is shown, which is designed for gait correction or gait maintenance, in particular for preventive support and for therapeutic treatment of the physiological gait pattern.

Figure 1:
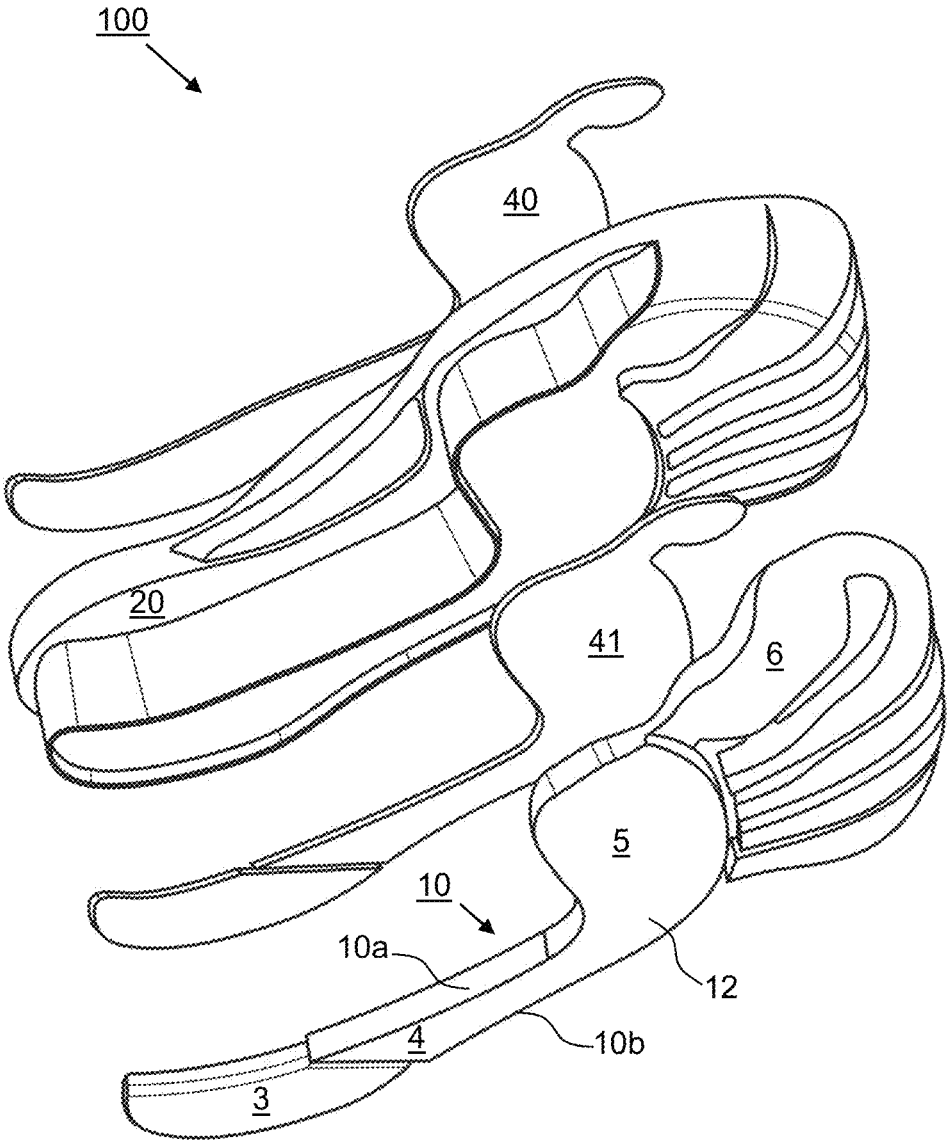
FIG. 1: is an exploded view of a first embodiment of a shoe sole according to the present invention.

As shown in FIG. 1, the shoe sole 100 comprises a heel section 3, a midfoot section 4, a ball of the foot section 5 and a forefoot section 6 on the ground contact surface 12 of its outsole 10 in a sequence running from a rear end to a front end along the shoe sole 100. The heel, midfoot and ball of the foot sections are each adjacent to an arch area below the arch of a foot 2 when wearing the shoe sole 100. The outsole can, for example, be designed as a durable anti-slip sole, which also provides a good grip on wet roads.

Furthermore, the shoe sole 100 comprises at least one substantially S-shaped guide element 40, 41 embedded between the ground contact surface 12 and a foot contact surface of the shoe sole 100 and formed to control the optimal movement of the foot. In other words, the guide element 40, 41 extends along a substantially S-shaped line (G) which starts at the heel section 3, extends along the midfoot section 4 and ball of the foot section 5 and ends at the forefoot section 6.

Figure 2:
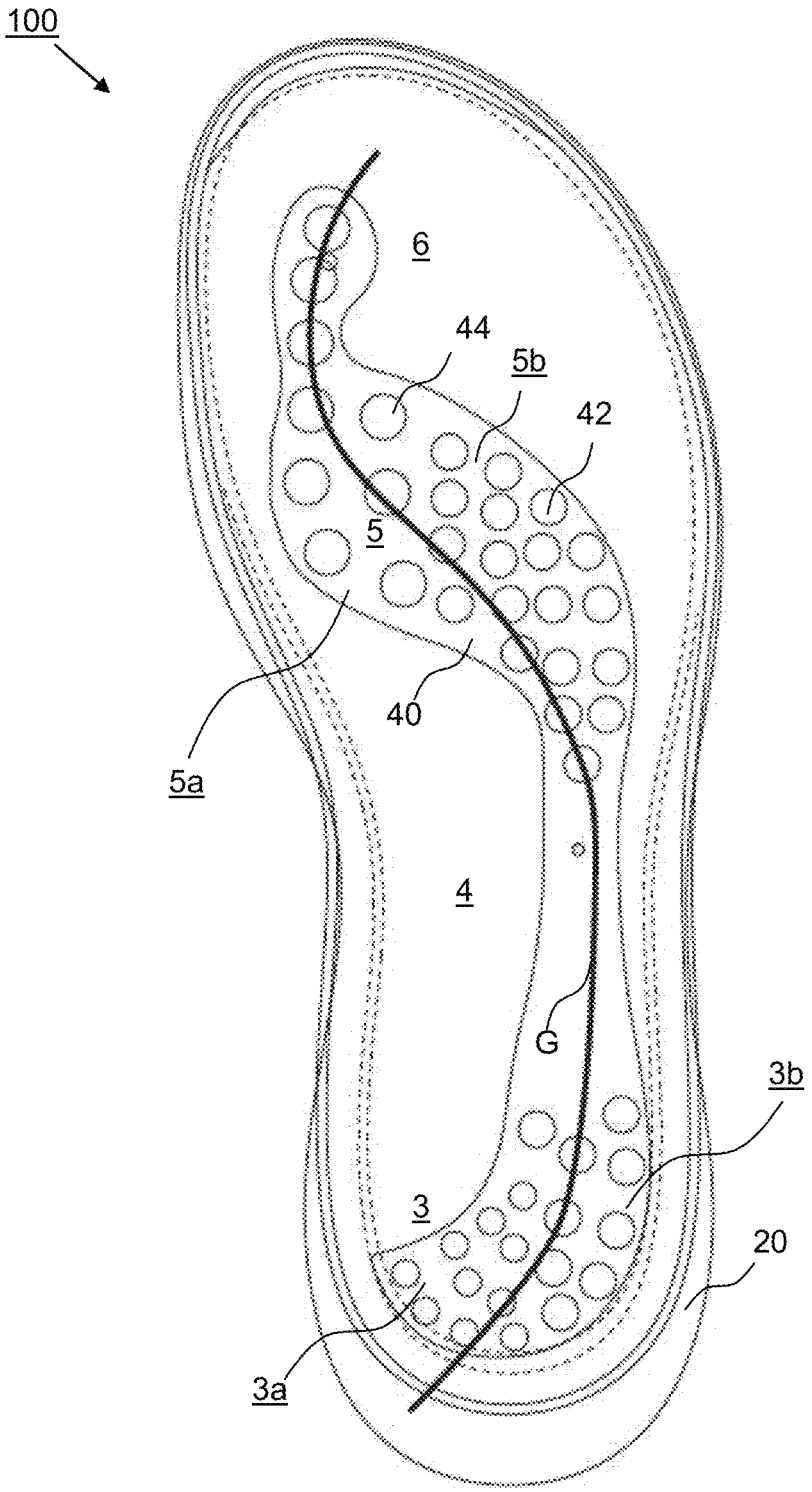
FIG. 2: Top view of the shoe sole from FIG. 1.
Figure 3:
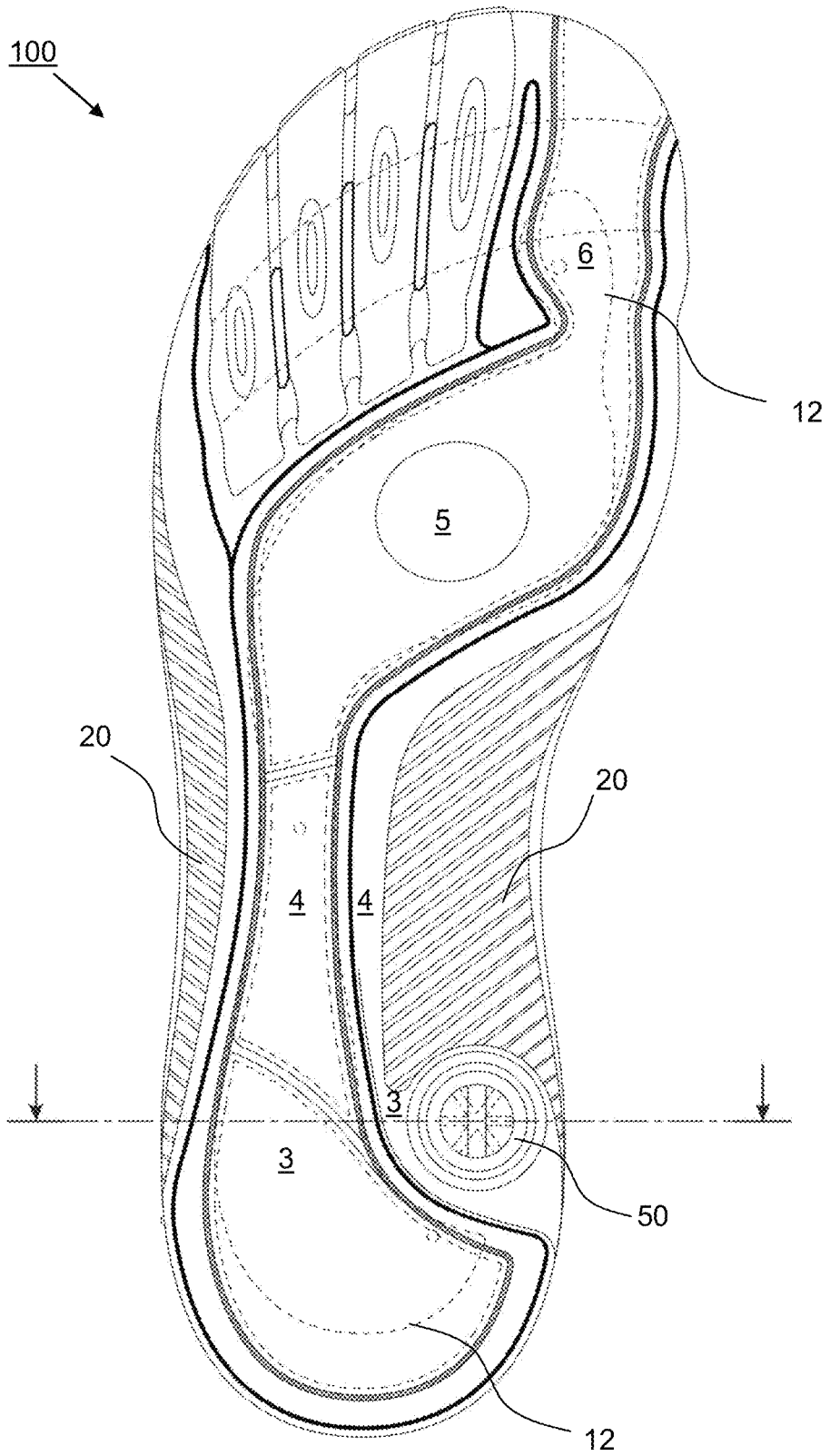
FIG. 3: Bottom view of the shoe sole from FIG. 1.
Figure 4:
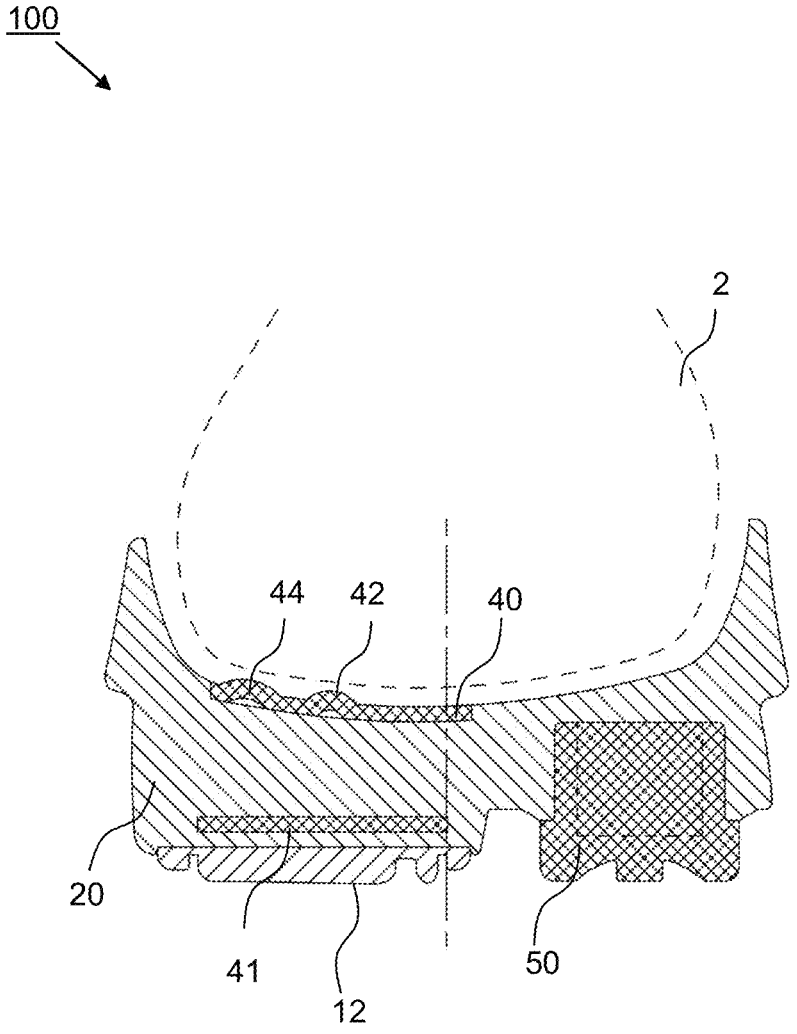
FIG. 4 cross-sectional view of the shoe sole from FIG. 1 along the sectional line shown in FIG. 3.
Figure 5:
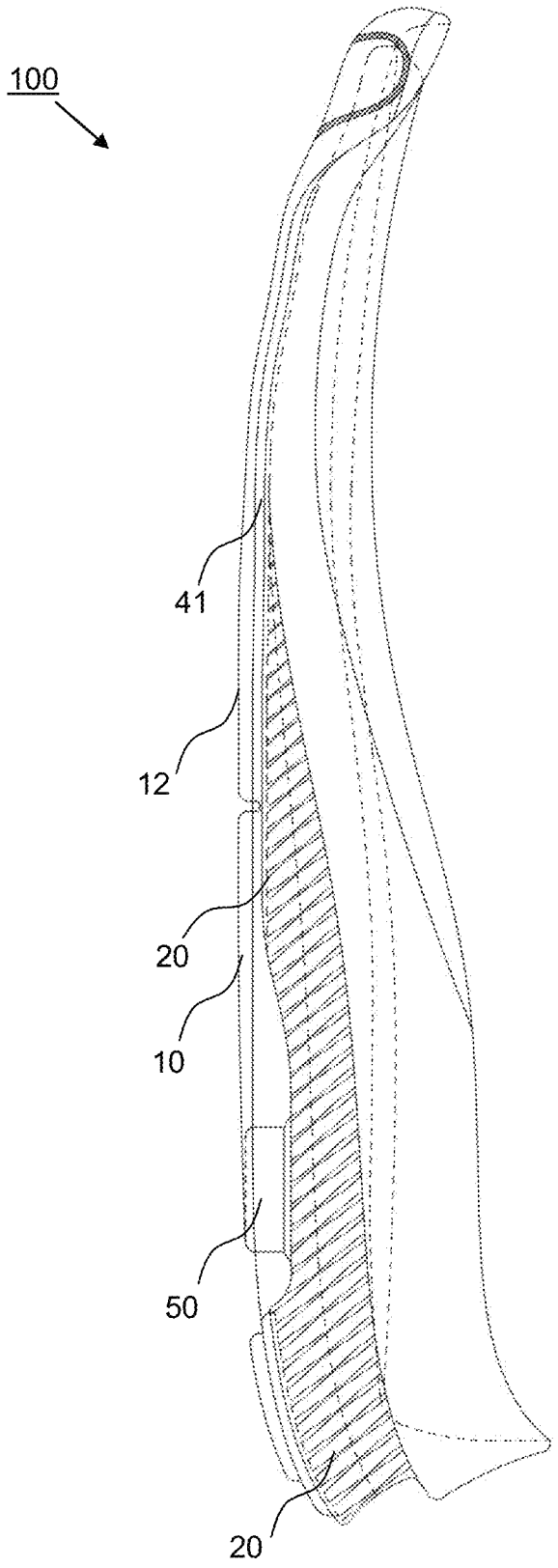
FIG. 5: Side view of the shoe sole from FIG. 1.

In the embodiment examples shown in FIGS. 1 to 8, the shoe sole 100 has a first guide element, namely a proprioceptive guide element 40 with elevations 42, 44 extending towards the foot contact surface (see FIGS. 2 and 4). This essentially S-shaped proprioceptive guide element 40 supports the pressure line of the foot 2 on contact with the ground as information on the physiological gait pattern. Furthermore, the pressure points serve to stimulate and improve blood circulation and thus as a light massage.

With regard to its properties, in particular with regard to the distribution of its hardness and/or its thickness as well as its arrangement in the shoe sole, and its shape, the proprioceptive guide element 40 can be designed like the second or upper insole described in the publication WO 2013056864 A1.

In addition, the shoe sole 100 has a further guide element 41 arranged between the ground contact surface 12 and the proprioceptive guide element 40, namely a stabilizing guide element 41, for example a guiding stability element, which is formed from a harder material than the shoe sole material surrounding the guide elements 40, 41. The local thickness and/or the local hardness of the stabilizing guide element 41 is therefore greater than the local thickness and/or the local hardness of the material of the shoe sole 100 surrounding the guide elements 40, 41, in particular laterally.

The stabilizing guide element 41 always guides the shoe back to its original position and thus prevents the shoe from slanting. For this purpose, the stabilizing guide element 41 is made of a harder material than a midsole 20.

With regard to its properties, in particular with regard to the distribution of its hardness and/or its thickness as well as its arrangement in the shoe sole and its shape, the stabilizing guide element 41 can be designed like the first insole described in the publication WO 2013056864 A1.

The material surrounding the guide elements 40, 41 is associated with the midsole 20 of the shoe sole 100. This midsole 20 can be designed with regard to its properties, in particular with regard to its shape, its material, its functions and its advantages, like the base body described in the publication WO 2013056864 A1.

The midsole 20 can be made of polyurethane, for example. The density of polyurethane enables high elasticity and gives the wearer of the shoe sole a very comfortable feeling. Polyurethane is also durable and remains stable even when exposed to heat and cold.

The guide elements 40, 41 are integrated into the midsole 20 when in use, for example glued to the midsole 20 or molded into the midsole.

The guide elements 40, 41 have a smaller width extension than the midsole 20. As shown in FIG. 1, the ground contact surface 12 advantageously has the same shape as the at least one guide element 40, 41.

FIGS. 1 to 6 thus show a shoe sole with an outsole 10, a midsole 20 and at least one essentially S-shaped guide element 40, 41. The outsole 10 has an essentially S-shaped ground contact surface 12. At least one of the guide elements 40, 41 is harder than the material of the shoe sole 100, which laterally surrounds the at least one substantially S-shaped guide element 40, 41. The ground contact surface 12 and the guide element 40, 41 are both narrower than the midsole 20 and are shaped such that they extend along the S-shaped line G.

The ground contact surface 12 is designed to cause transverse instability of the foot 2 when walking or running. The at least one guide element or at least one of the guide elements 40, 41 is designed to provide the wearer's foot 2 with a localized increase in pressure along the gait line.

The outsole 10 also has a removable stabilization element 50, which is designed to provide additional ground contact in the heel section 3 and medially to the ground contact surface 12. The stabilization element 50 can optionally be inserted or removed in order to increase the lateral stability of the foot when walking or running. Lateral stability of the foot is understood here to mean the stability of the foot about its longitudinal axis. The transverse stability thus counteracts a rolling tendency of the foot about its longitudinal axis.

A cross-section through the heel area of a shoe sole 100, which is suitable for a left shoe, is shown in FIG. 4.

The stabilization element 50 can, for example, be made of at least one material selected from the group of thermoplastic polyurethanes (TPU).

The stabilization element 50 guides the hindfoot or heel bone by giving the shoe support in torsion. In this way, the stabilization element 50 always guides the hindfoot back to its natural, original position. The stabilization element 50 therefore prevents the foot from buckling, twisting or deforming prematurely.

Laterally on the outside, the ground contact surface 12 is also narrower than the shoe sole 100 in the heel area 3. Thus, transverse instability is maintained in the heel area despite the stabilization element 50.

Figure 6:
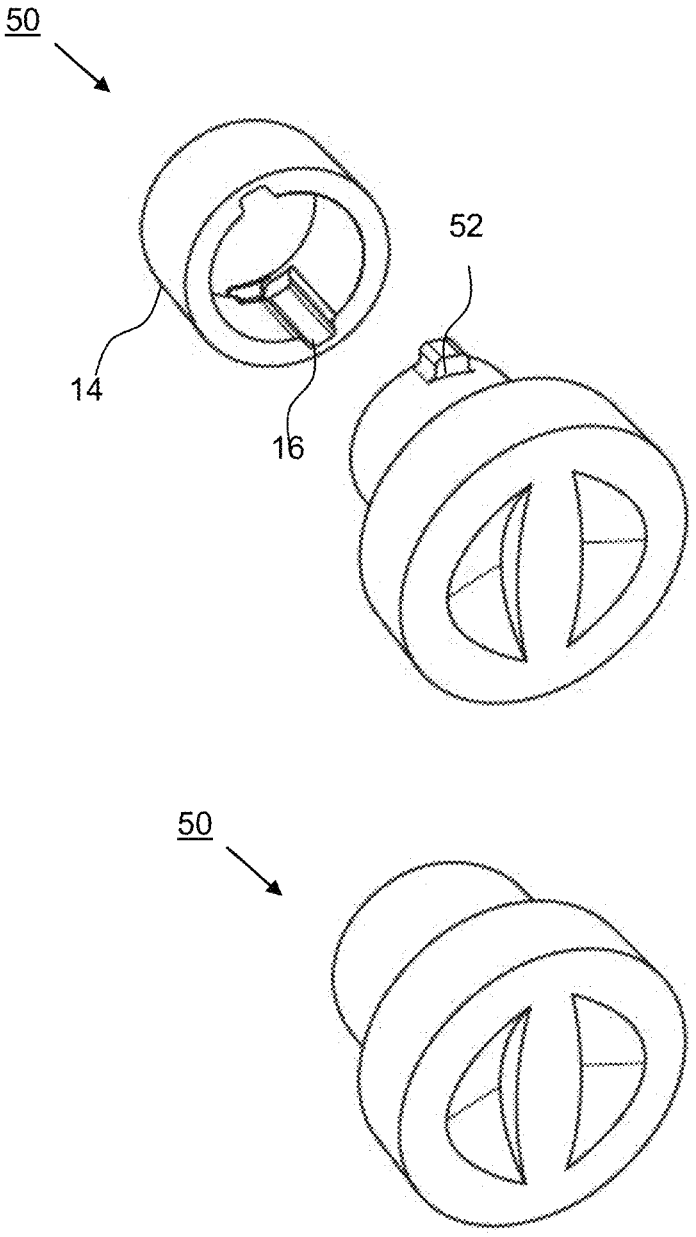
FIG. 6 Exploded view and assembled arrangement of the stabilizing element of the shoe sole from FIG. 1.

To accommodate the stabilization element 50, the outsole 10 advantageously has a receiving element 14. As shown in FIG. 6, the receiving element 14 can have a fastening means 16, which is designed to cooperate with a complementary fastening means 52 of the stabilization element 50 in such a way that the stabilization element 50 can be detachably fastened in the receiving element 14. Furthermore, the stabilizing element 50 can also be held in the shoe sole by means of at least one plug-in connection and/or by means of at least one screw connection.

As described above and shown in FIGS. 2 and 4, the at least one guide element or at least one of the guide elements 40, 41 may have a plurality of proprioception-enhancing elevations or projections 42, 44 on its surface facing the foot 2. These proprioception-promoting elevations 42, 44 may, for example, have a bubble-like shape. The elevations can be formed in two or three different sizes, for example, whereby the foot can be guided towards the gait line G. The proprioceptive guiding element 40, 41 is preferably formed in one piece with the proprioception-promoting elevations 42, 44.

Figure 7:
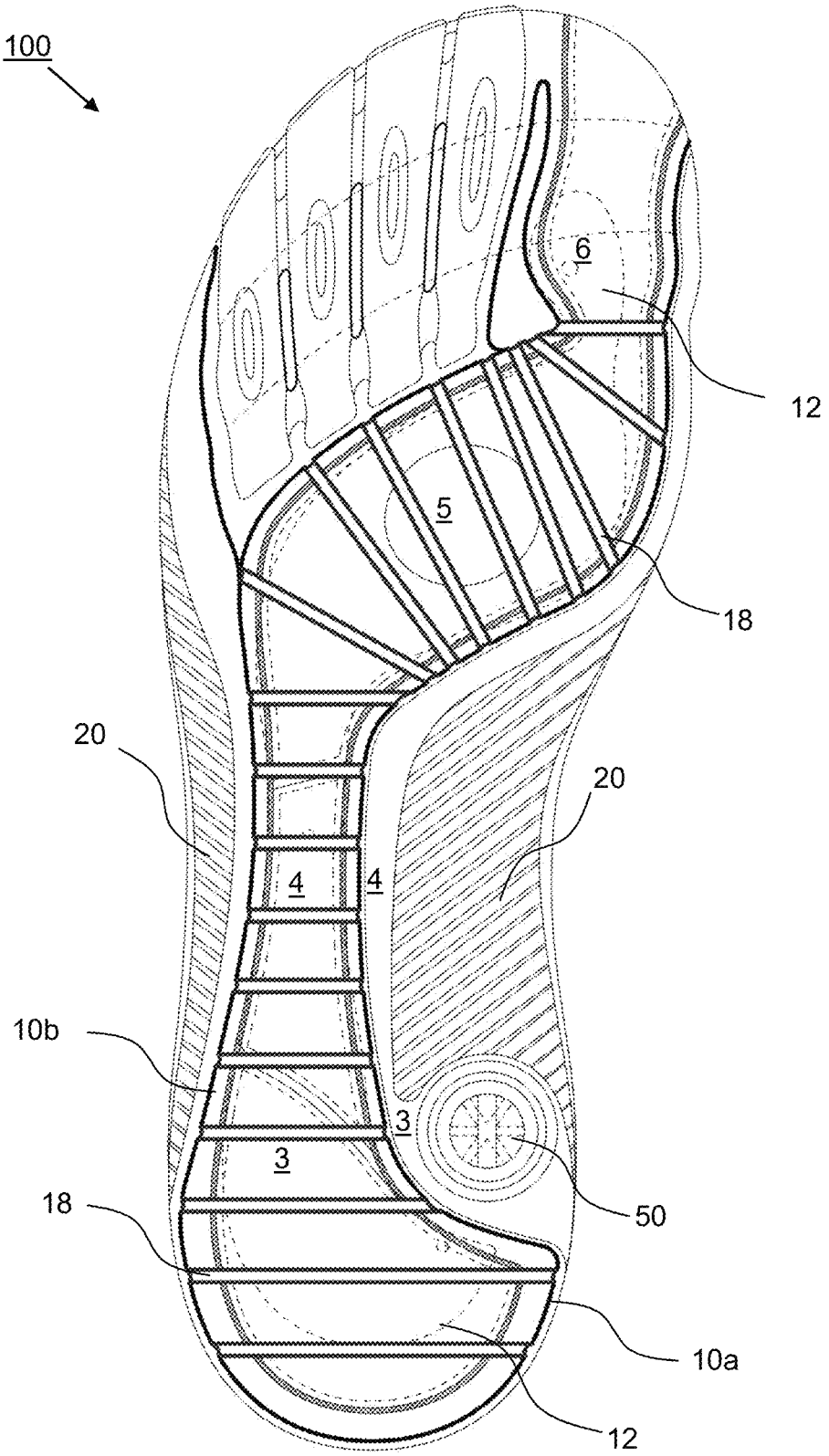
FIG. 7: Bottom view of a second embodiment of a shoe sole according to the present invention.
Figure 8:
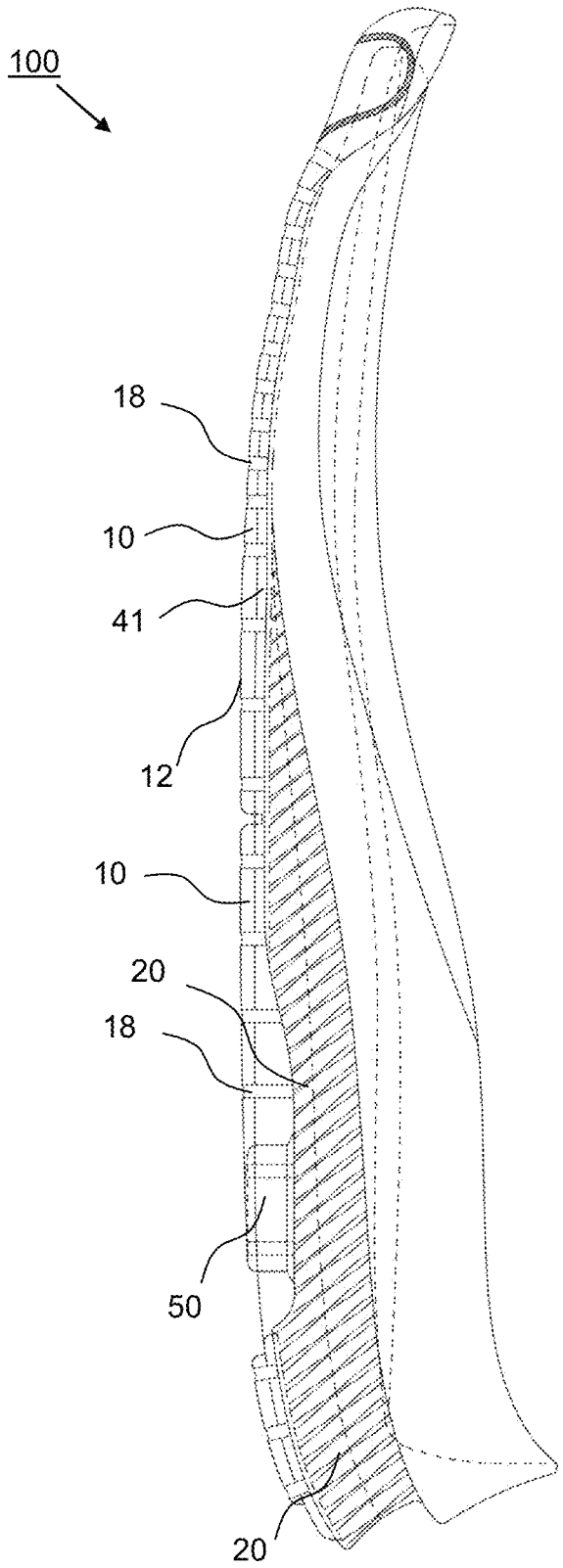
FIG. 8: Side view of the shoe sole from FIG. 7.

The second embodiment example of the shoe sole according to the present invention shown in FIGS. 7 and 8 differs from the embodiment example shown in FIGS. 1 to 6 in that recesses 18, for example U-shaped or V-shaped transverse notches, such as transverse flexion grooves, are arranged in the outsole and in the midsole. These recesses 18 run transversely to the S-shaped line in the forefoot area and have the effect of making the shoe sole even more flexible and easier to roll.

The notches can have a depth of at least 2 mm to a maximum of 1 cm extending from the ground contact surface 12 to the central sole 20. Furthermore, the notches can have a width of 1 mm to 1 cm at the ground contact surface. The longitudinal spacing of the notches can be between 1 mm and 10 mm, preferably between 1 mm and 6 mm, for example.

The shoe sole shown in FIGS. 1 to 8 enables the wearer to roll better and thus to walk more upright and healthier. The sole of the shoe guides the foot with gentle pressure along the S-shaped line G by means of the proprioceptive guide element 40.

REFERENCE LIST

2 Feet

3 Heel section or heel area or hindfoot area, in particular area of the heel bone

**3*a*** Medial heel section, arranged medial to the S-shaped line

**3*b*** Lateral heel section, arranged laterally to the S-shaped line

4 Midfoot section or midfoot area

5 Ball of the foot section or ball of the foot area

**5*a*** medial section of the ball of the foot, arranged medial to the S-shaped line

**5*b*** lateral section of the ball of the foot, arranged laterally to the S-shaped line

6 Forefoot section or forefoot area, especially toe area

**6*a*** medial forefoot section, arranged medial to the S-shaped line

**6*b*** lateral forefoot section, arranged laterally to the S-shaped line

10 Outsole

**10*a* medial side or inner side of the outsole 10**

**10*b* lateral side or outer foot side of the outsole 10**

12 Floor contact area of the outsole 10

14 Receiving element of the outsole 10 for receiving the stabilizing element 50

16 Fastening means of the mounting element 14

18 Recess, in particular transverse notch for more dynamic rolling, for example transverse flex groove

20 Midsole, e.g. midsole or body of the shoe sole 100

40 Proprioceptive guide element with elevations 42, 44 extending towards the foot contact surface

41 Stabilizing guide element, in particular guiding stability element

42 Elevation or proprioception-promoting projection, in particular spherical segment, of the proprioceptive element 40 extending towards the foot contact surface, for example elevation with a height of approximately 1 mm

44 Further elevation or proprioception-promoting projection, in particular further spherical segment, of the proprioceptive element 40 extending towards the foot contact surface, for example elevation with a height of approximately 2 mm

50 Stabilization element

52 Fastening means of the stabilization element 50

100 Shoe sole

G S-shaped line, in particular physiological hydrograph

EMBODIMENTS

Embodiment 1. A shoe sole (100) for a footwear, the shoe sole (100) comprising an outsole (10) having a ground contacting surface (12), the ground contacting surface (12) comprising a heel section (3), a midfoot section (4), a ball of the foot section (5) and a forefoot section (6) in a sequence running from a rear end to a front end along the shoe sole (100);

wherein the shoe sole (100) comprises at least one guide element (40, 41) embedded between the ground contact surface (12) and a foot contact surface of the shoe sole (100) and designed to control the optimum movement sequence of the foot, wherein the guide element (40, 41) has a smaller width extension than the shoe sole (100) and extends along an S-shaped line (G), wherein the S-shaped line (G) starts at the heel section (3), runs along the midfoot (4) and ball of the foot section (5) and ends at the forefoot section (6), characterized in that the guide element (40) is a proprioceptive guide element and has elevations (42, 44) extending towards the foot contact surface, wherein the elevations (42, 44) are arranged at least in regions along the S-shaped line and are designed to impart a localized increase in pressure to the foot (2) of the wearer of the shoe sole (100).

Embodiment 2. Shoe sole according to embodiment 1, characterized in that the elevations (42, 44) are designed as spherical segments.

Embodiment 3. Shoe sole according to one of embodiments 1 or 2, characterized in that the elevations (42, 44) are located in the region of the heel section (3), the ball of the foot section (5) and the forefoot section (6).

Embodiment 4. Shoe sole according to embodiment 3, characterized in that the elevations (42, 44) in a medial heel section (3*a*) arranged medially from the substantially S-shaped line (G) have a smaller height and/or a smaller volume than the elevations (42, 44) in a lateral heel section (3*b*) arranged laterally from the substantially S-shaped line (G).

Embodiment 5. Shoe sole according to embodiment 3 or 4, characterized in that the elevations (42, 44) in a medial foot ball section (5*a*) arranged medially from the substantially S-shaped line (G) have a greater height and/or a greater volume than the elevations (42, 44) in a lateral foot ball section (5*b*) arranged laterally from the substantially S-shaped line (G).

Embodiment 6. Shoe sole according to at least one of embodiments 1 to 5, characterized in that the shoe sole (100) has at least one midsole (20) arranged between the outsole (10) and the proprioceptive guide element (40), the proprioceptive guide element (40) being narrower than the midsole (20), in particular in that the ground contact surface (12) and the proprioceptive guide element (40) are both narrower than the midsole (20).

Embodiment 7. Shoe sole according to embodiment 6, characterized in that the ground contact surface (12) is narrower than the midsole (20) in such a way that transverse instability of the foot (2) is brought about when walking or running, and the outsole (10) furthermore has at least one stabilizing element (50) which is detachably fastened in the shoe sole (100), wherein the stabilizing element (50)

extends out of the shoe sole (100) in the direction of and up to the plane of the ground contact surface (12), is arranged in the region of the heel section (3) and medially to the substantially S-shaped line (G), and can optionally be inserted into the shoe sole (100) or removed from the shoe sole (100) in order to increase the transverse stability of the foot (2) when walking or running.

Embodiment 8. Shoe sole according to at least one of embodiments 1 to 7 characterized in that the proprioceptive guide element (40) is made of a harder material than the shoe sole material which surrounds the proprioceptive guide element (40), in particular laterally.

Embodiment 9. Shoe sole according to at least one of embodiments 1 to 8, characterized in that the outsole (10) has recesses (18) extending from a medial side (10*a*) of the outsole (10), as seen from the substantially S-shaped line (G), to a lateral side (10*b*) of the outsole (10), as seen from the substantially S-shaped line (G), in particular transversely to the shoe sole (100) or at right angles to the S-shaped line (G), for example U-shaped or V-shaped notches, the width of which corresponds to the width of the proprioceptive guide element (40) and which are arranged at a distance from one another along the S-shaped line (G) on the heel section (3), on the metatarsal section (4) and on the ball of the foot section (5).

Embodiment 10. Shoe sole according to at least one of embodiments 1 to 9, characterized in that the shoe sole has, in addition to the proprioceptive guide element (40), at least one further guide element (41), the further guide element (41) being designed as a stabilizing guide element (41) which is arranged between the ground contact surface (12) and the proprioceptive guide element (40) and is made of a harder material than the shoe sole material which laterally surrounds the stabilizing guide element (40).

Embodiment 11. Shoe sole according to embodiments 9 and 10, characterized in that the recesses (18) extend through the stabilizing quide element (41) and interrupt it.

Embodiment 12. Shoe sole according to embodiment 10 or 11, characterized in that the stabilizing guide element (41) is made of a harder material than the proprioceptive guide element (40), in particular in that the hardness of the stabilizing guide element (41) is in the range from about 80 Shore to about 98 Shore and the hardness of the proprioceptive guide element (40) is in the range from about 75 Shore to about 90 Shore.

Embodiment 13. Shoe sole according to at least one of embodiments 10 to 12, characterized in that, in addition to the proprioceptive guide element (40), the stabilizing guide element also has the elevations (42, 44) extending to the foot contact surface, which are designed to impart a localized increase in pressure to the foot of the wearer of the shoe sole (100).

Embodiment 14. A shoe sole (100) for a footwear, the shoe sole (100) comprising an outsole (10) having a ground contacting surface (12), the ground contacting surface (12)

comprising a heel section (3), a midfoot section (4), a ball of the foot section (5) and a forefoot section (6) in a sequence running from a rear end to a front end along the shoe sole (100); wherein the shoe sole (100) comprises at least one guide element (40, 41) embedded between the ground contact surface (12) and a foot contact surface of the shoe sole (100) and designed to control the optimal movement sequence of the foot, wherein the guide element (40, 41) has a smaller width extension than the shoe sole (100) and extends along an S-shaped line (G), wherein the S-shaped line (G) begins at the heel section (3), extends along the midfoot section (4) and ball of the foot section (5) and ends at the forefoot section (6), and wherein the ground contact surface (12) extends along the S-shaped line (G) and is narrower than the shoe sole (100) in order to provide transverse instability of the foot (2) when walking or running, characterized in that in that the shoe sole (100) has, in the heel section (3) arranged medially to the substantially S-shaped line (G), a stabilizing element (50) which can be detachably fastened in the shoe sole (100) and which extends out of the shoe sole (100) in the direction of and up to the plane of the ground contact surface (12).

Embodiment 15. A shoe comprising a shoe sole according to at least one of embodiments 1 to 14.

The invention claimed is:

1. A shoe sole for a footwear, the shoe sole comprising an outsole having a ground contacting surface, the ground contacting surface comprising a heel section, a midfoot section, a ball of the foot section and a forefoot section in a sequence running from a rear end to a front end along the shoe sole; wherein the shoe sole comprises at least one guide element embedded between the ground contact surface and a foot contact surface of the shoe sole and designed to control the optimal movement sequence of the foot, wherein the guide element has a smaller width extension than the shoe sole and extends along an S-shaped line, wherein the S-shaped line begins at the heel section, extends along the midfoot section and ball of the foot section and ends at the forefoot section, and wherein the ground contact surface extends along the S-shaped line and is narrower than the shoe sole in order to provide transverse instability of the foot when walking or running, wherein in that the shoe sole has, in the heel section arranged medially to the substantially S-shaped line, a single stabilizing element which can be detachably fastened in the shoe sole and which extends out of the shoe sole in the direction of and up to the plane of the ground contact surface.

2. A shoe comprising a shoe sole according to claim 1.

* * * * *